United States Patent [19]

Schmuck et al.

[11] Patent Number: 4,540,051

[45] Date of Patent: Sep. 10, 1985

[54] ONE TRIP PERFORATING AND GRAVEL PACK SYSTEM

[75] Inventors: Phillip W. Schmuck, Spring; John V. Salerni, Kingwood; Rodney J. Wetzel, Woodlands, all of Tex.

[73] Assignee: Baker International Corporation, Orange, Calif.

[21] Appl. No.: 692,337

[22] Filed: Jan. 17, 1985

Related U.S. Application Data

[63] Continuation of Ser. No. 501,262, Jun. 6, 1983, , which is a continuation of Ser. No. 250,772, Apr. 3, 1981, abandoned.

[51] Int. Cl.[3] ..... E21B 43/04; E21B 43/10

[52] U.S. Cl. ..... 166/278; 166/297; 166/51; 175/4.52

[58] Field of Search ..... 166/51, 55, 55.1, 297, 166/278; 175/4.51, 4.52

[56] References Cited

U.S. PATENT DOCUMENTS

| | | | |
|---|---|---|---|
| 3,072,204 | 1/1963 | Brown | 166/51 |
| 3,361,204 | 1/1968 | Howard et al. | 175/4.52 |
| 3,627,046 | 12/1971 | Miller | 166/51 |
| 3,726,343 | 4/1973 | Davis, Jr. | 166/51 |
| 3,913,676 | 10/1975 | Barbee, Jr. et al. | 166/51 |
| 3,939,927 | 2/1976 | Bohn | 166/297 |
| 4,372,384 | 2/1983 | Kinney | 166/278 |

*Primary Examiner*—Stephen J. Novosad
*Assistant Examiner*—Thuy M. Bui
*Attorney, Agent, or Firm*—Norvell & Associates

[57] ABSTRACT

The invention provides a method and apparatus for effecting the perforating of a well casing and the gravel packing of the perforated areas of the well casing with one trip into the well of a combined perforating and gravel packing apparatus. This desirable objective is accomplished by a design of the crossover mandrel normally employed in gravel packing apparatus. The mandrel disclosed herein provides, in its run-in position, a continuous axial passage through its entire length, permitting a detonating bar to be dropped therethrough to actuate a perforating gun. Subsequent to the perforation operation, a ball is dropped and seated on an annular sleeve carried within the hollow mandrel which permits the development of internal pressure within the mandrel. Such internal pressure is employed not only to effect the setting of a fluid pressure actuated packer but also to shift the ball supporting sleeve downwardly and uncover a crossover port in the mandrel which permits the gravel packing operation to be carried out conventionally.

3 Claims, 8 Drawing Figures

ONE TRIP PERFORATING AND GRAVEL PACK SYSTEM

CROSS-REFERENCE TO RELATED APPLICATIONS

This application is a continuation of application Ser. No. 501,262, filed June 6, 1983, which in turn is a continuation of application Ser. No. 250,772, filed Apr. 3, 1981, now abandoned.

BACKGROUND OF THE INVENTION

1. Field of the Invention

This invention relates to a method and apparatus for effecting the perforating and the gravel packing of a production zone in a subterranean well by a single trip of a work string into the well which carries both perforating and gravel packing apparatus.

2. Description of the Prior Art

As oil and gas wells are drilled to constantly increasing depths, the cost of completion or workover of a well is disproportionally increased by the number of trips of completion apparatus that must be made into the well in order to effect its completion or workover. Necessarily, every encassed producing well has to have the casing perforated in the production zone. It is equally necessary in the case of many wells to provide gravel packing in the area of the perforations to filter out sand produced with the production fluids and thus prevent its entry into the well bore and through the production conduit. It has heretofore been necessary to make several trips of a work string into the well in order to first effect the perforation of the well casing and then the gravel packing of one or more production zones surrounding the perforations. Most commonly used tubing conveyed perforating apparatus rely upon percussion firing of explosive charges. Such firing is produced by dropping a weight through the tubular work string to fire a primer carried by the perforating apparatus located at the bottom of the well. It is therefore necessary that the bore of the tubular work string be unrestricted, at least to the extent to permit the free passage of the firing weight or bar therethrough.

It has previously been suggested that the gravel packing of a plurality of production zones of a well could be accomplished in a single trip of a specially designed gravel packing apparatus into the well. Such apparatus is, for example, disclosed in U.S. Pat. No. 3,987,854 to Callihan et al. and also in the copending application Ser. No. 170,494, filed July 21, 1980, and assigned to the assignee of the present application. In both instances, however, the crossover tool which forms an essential part of such multiple zone gravel packing apparatus, has not provided an unrestricted axial passage through the crossover apparatus. Therefore, it has been a practical impossibility to enter the well with both a perforating apparatus and a gravel packing apparatus and accomplish both operations in the same trip.

SUMMARY OF THE INVENTION

This invention provides an improved apparatus for the completion of subterranean oil wells which permits the perforation of the casing at a production zone in the well and the subsequent gravel packing of a liner, screen or other filtering means positioned adjacent to the casing perforations with a single trip of the required apparatus into the well, following which the mandrel element of the gravel packing apparatus may be removed from the well, and the work string replaced by production tubing, permitting the well to be placed immediately in production.

The apparatus of this invention incorporates a unique crossover flow control mandrel for a gravel packing apparatus which, in its run-in position, defines an unimpeded axial passage through the entire gravel packing apparatus. This permits a firing weight to be freely dropped through the gravel packing apparatus to fire a perforating mechanism disposed at the bottom end of the gravel packing apparatus. During the run-in and perforating operation, a radial passage through the gravel packing mandrel, which provides communication from the interior of the bore of the mandrel through the annular fluid passage surrounding such bore into the annulus between the mandrel and the liner assembly, is closed by a sleeve which carries a ball valve seat at its upper end. The sleeve is retained in this position by a shear pin. Following the perforating operation, a ball is dropped onto the ball seat permitting fluid pressure within the work string to be increased sufficiently to set a fluid pressure operated packer. Further increase in pressure will cause a shearing of the shear pin and a downward movement of the ball seat sleeve to uncover the radial passage in the crossover mandrel assembly, thus restoring the fluid flow passages through the crossover mandrel to their normal configuration which permits the flow of gravel carrying fluid downwardly through the bore of the mandrel, thence outwardly through the uncovered radial passage into the annulus between the mandrel and the sleeve assembly, thence outwardly into the annulus between the liner assembly and the casing, and thence downwardly into the area between the screen and the casing perforations. The return fluid passes through the screen, thence into the annular passage surrounding the bore of the mandrel, and thence outwardly into the casing annulus through a radial port located above the packer, in conventional fashion.

Additionally, this invention provides a flapper valve below the ball valve which is normally held in an inoperative position relative to the continuous axial passage through the gravel packing apparatus until after the perforation of the well has been accomplished by the dropping of the firing weight, and the work string has been pressurized above the ball seat sleeve. Such flapper valve is held in its open position by a retaining sleeve and is spring biased to a closed position. The flapper valve is caused to move to its closed position after completion of the perforating operation by downward movement of the ball seat sleeve, and isolates the bore of the screen, hence the formation, from reverse fluid flow after the gravel packing is accomplished.

DESCRIPTION OF THE PREFERRED EMBODIMENTS

Figure 1A:
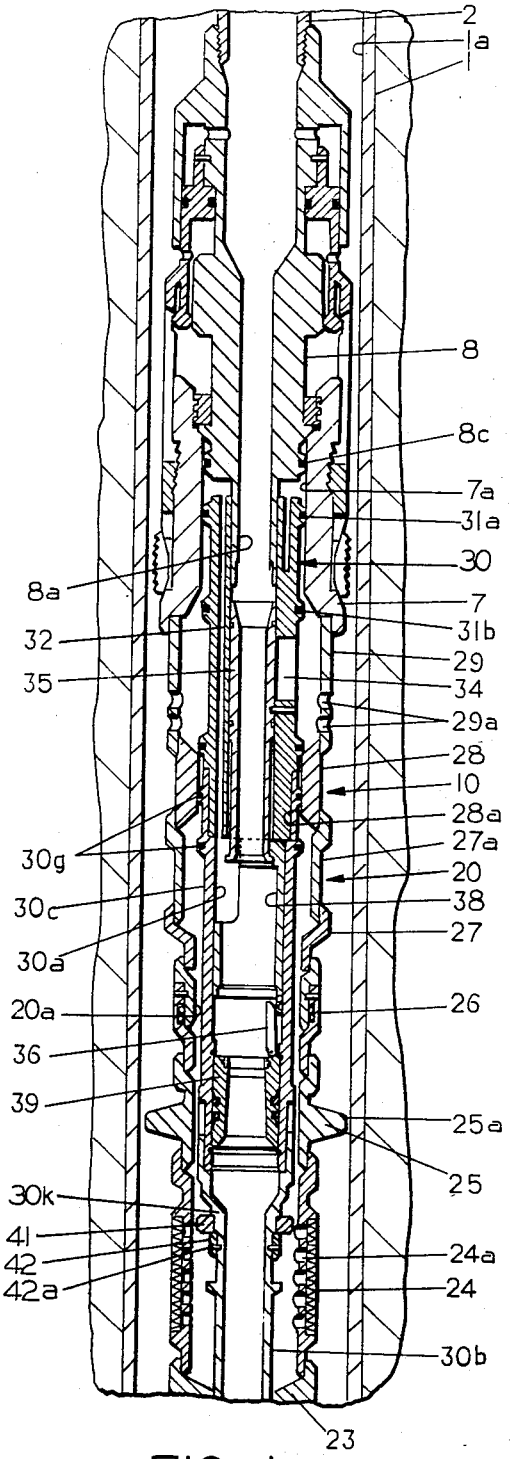
FIGS. 1*a* and 1*b* constitute a schematic vertical sectional view of a combined perforating and gravel packing apparatus incorporating this invention, shown with the components thereof in their run-in positions, FIG. 1*b* being a vertical continuation of FIG. 1*a*.
Figure 1B:
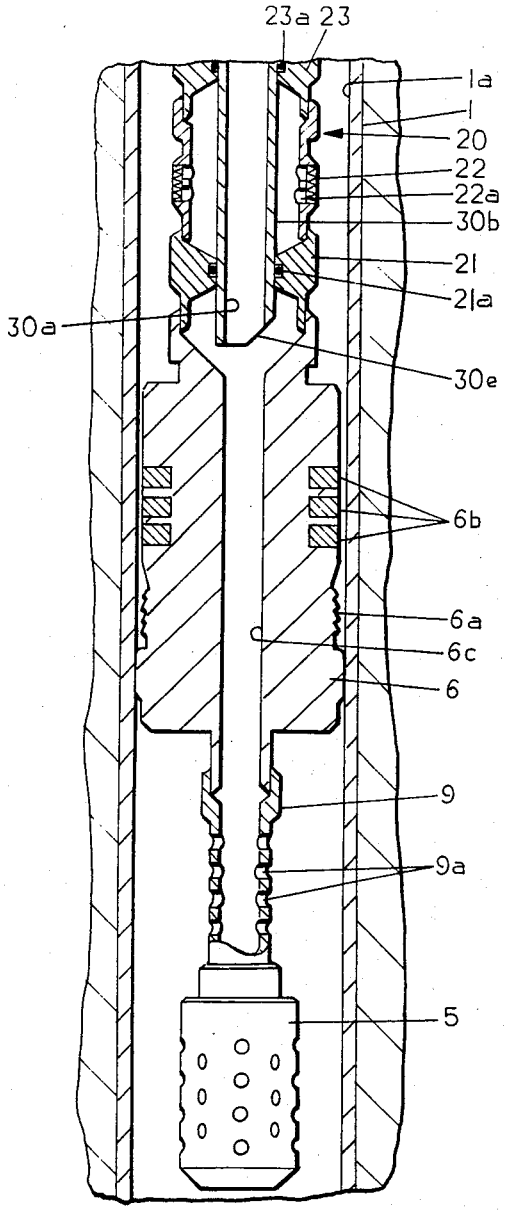

Referring now to FIGS. 1*a*–1*b*, there is shown a combined gravel packing and perforating apparatus 10 embodying this invention with all of the elements of the apparatus shown in their "run-in" position within the bore 1*a* of a well casing 1. Major components of the apparatus 10 include a percussion actuated perforating gun 5, which is supported in depending relationship from a first packer element 6 by a nipple 9 having radial wall perforations 9*a*. The packer element 6 is in turn suitably secured to the bottom end of a hollow liner assembly 20. On the top end of the liner assemblage 20, a second packer 7 is conventionally secured. The packer 7 is of the type having a fluid pressure responsive actuator 8 which is detachably secured to the packer 7 and has its upper end secured to the end of a tubular work string 2. Depending from the actuator 8 is a hollow crossover mandrel 30. The axial bore 30*a* of the hollow crossover mandrel 30 extends entirely through the length of the assembly and is in direct communication with the bore 6*c* of the lower packer 6 and the bore of the nipple 9, hence providing direct communication with the percussion actuated perforating gun 5.

The perforating gun 5 may be any one of several well known types which contains explosive charges which are detonated to fire a plurality of radially directed charges through the walls of the casing 1, thus producing casing perforations 1*b* (FIG. 2) and associated perforations in the surrounding production zone of the well bore. From the description thus far, it will be readily apparent that in the run-in position of the combined perforating and gravel packing apparatus, there is provided an unrestricted axial passage from the tubular work string 2 to the perforating gun 5, thus permitting a detonating weight or bar 5*a* (FIG. 2) to be dropped onto the gun 5 from the top of the well to effect its discharge and the production of perforations 1*b* in the well casing and the surrounding production zone.

All of the aforedescribed major components of the combined perforating and gravel packing apparatus 10 are assembled to the end of the tubular work string 2 at the well head and are lowered into the casing 1 by the work string 2 until the perforating gun 5 is positioned adjacent a desired production zone.

The lower packer 6 is of the type known in the art as a mechanically actuated, retrievable packer. In other words, through mechanical manipulation of the work string 2, the lower packer 6 may be expanded into sealing engagement with the interior bore 1*a* of casing 1 at any selected point. Further manipulation of the work string 2 will result in the collapsing of the lower packer 6 to permit it to be moved to another position. The packer 6 may, for example, comprise the Baker Model R-3 Single Grip Retrievable Casing Packer.

Figure 2:
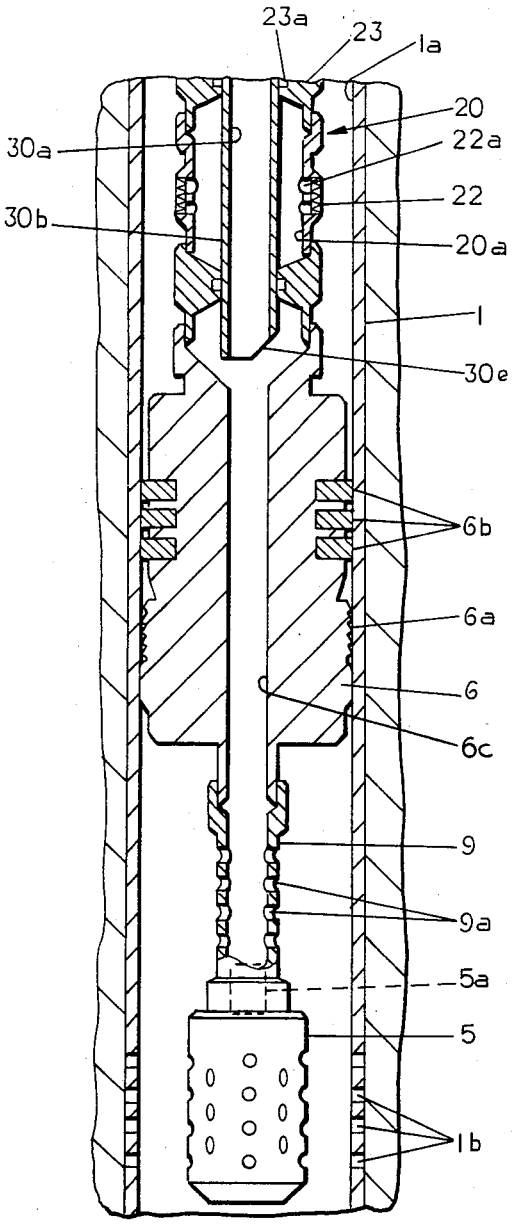
FIG. 2 is a view similar to FIG. 1*b* but showing the operation of the perforating gun.

Thus, the first step involved in the process after the run-in of the combined perforating and gravel setting apparatus 10 into the well casing is to effect the setting of the lower packer 6 by manipulation of the work string 2. This results in the expansion of gripping teeth 6*a* and annular seals 6*b* conventionally provided on the packer into engagement with the casing bore 1*a* (FIG. 2).

As previously mentioned, the top end of the lower packer 6 is conventionally secured, as by threads, to the bottom end of an elongated liner assembly 20. The liner assembly 20 is constructed in the same general manner as the liner assembly employed in the gravel packing apparatus described in the aforementioned U.S. Pat. No. 3,987,854. The construction of the liner assembly 20 will not, therefore, be described in great detail, but the principal elements thereof, starting at the bottom of the liner assembly (FIG. 1*b*) and moving upwardly, include the following items:

First is an O-ring seal sub 21 providing a mounting for an O-ring seal 21*a* which cooperates in sealing relationship with the lower tubular portion 30*b* of the crossover mandrel 30.

Next, the top end of the O-ring seal sub 21 is threadably secured to a conventional telltale screen 22 employed in gravel packing apparatus. Screen 22 provides a plurality of radially disposed small area passages 22*a* communicating between the casing annulus and the interior of the hollow screen assemblage 22. The passages 22*a* are sufficiently small in size to provide a barrier for the passage of the size of gravel particles with which the well is to be packed.

Then, the top end of telltale screen 22 is in turn threadably secured to the bottom end of a second O-ring seal sub 23 which defines a support for an O-ring 23*a* which also sealingly engages the lower tubular portion 30*b* of the hollow crossover mandrel 30.

The top end of the O-ring seal sub 23 is threadably engaged to the bottom of a main screen 24 around which the primary gravel pack is to be placed. The screen 24 may be of any one of several well known constructions and defines a plurality of radially disposed, restricted area fluid passages 24*a* which are sized to freely permit fluid flow therethrough from the casing annulus but prevent passage of the gravel particles of the size to be employed in the gravel packing operation.

The top end of the main screen 24 is threadably secured to the lower end of a blank pipe 25 which is provided with a radially projecting centering flange 25*a*. The top end of the blank pipe 25 is in turn threadably connected to the lower end of a conventional shearout safely joint 26 which permits release of component parts of the apparatus, including the upper packer 7, in the event that the apparatus becomes stuck in the well bore. The shearout safety joint 26 may be of conventional construction.

The top end of the shearout safety joint 26 is threadably secured to the lower end of a crossover sub 27 which has a larger interior diameter. The top of crossover sub 27 is threadably secured to the bottom end of a blank pipe 27*a* which has its top threadably end secured to a seal bore unit 28 which defines an internal sealing surface 28*a* for cooperation with seals 30*g* provided on the enlarged upper end 30*c* of the hollow crossover mandrel 30. Lastly, the top end of seal bore unit 28 is threadably secured to a connecting sleeve 29 having radial passages 29*a* formed therein and its top end threadably secured to the lower end of the upper packer 7.

The upper packer 7 may be any one of several well known types which may be set by the fluid pressure operated actuator 8. For example, upper packer 7 may comprise Baker model "SC-1 Packer". Since the construction and operation of this type of actuator and packer is entirely conventional, it will not be further described. The actuator 8 is detachably secured to upper packer 7 in conventional fashion and threadably secured at its top end to the lower end of the tubular work string 2.

A hollow crossover mandrel 30 is suitably secured in depending relation to actuator 8 by engagement with a depending sleeve portion 8*a* of actuator 8. Starting from the top of the crossover mandrel 30, there is first provided a pair of axially spaced, annular seats for seals 31*a* and 31*b*. Seal 31*a* slidably and sealingly engages a seal bore surface 7*a* formed in the upper packer 7. The seal 31*b* provides sealing engagement with the bore 7*a* of the packer 7 when the crossover mandrel is raised relative to the packer by actuator 8 in a manner to be hereinafter described.

The mandrel assembly 30 also defines an annular fluid passage 32, open at its top end, which extends downwardly and has a semi-annular lower end 32*a* (FIG. 4) communicating with the bore 30*a* extending through the upper portion 30*c* and the lower end 30*b* of the mandrel assembly 30.

Near the upper extremity of the enlarged upper portion 30*c* of the hollow crossover mandrel, a radial crossover port 34 is provided which permits fluid to pass from the axial bore 30*a* of the hollow mandrel to the exterior of the mandrel, passing through, but not communicating with the annular passage 32. Port 34 thus provides communication between the mandrel bore 30*a* and the annulus that exists between the exterior of the hollow crossover mandrel 30 and the interior bore 20*a* of the liner assembly 20.

Figure 4:
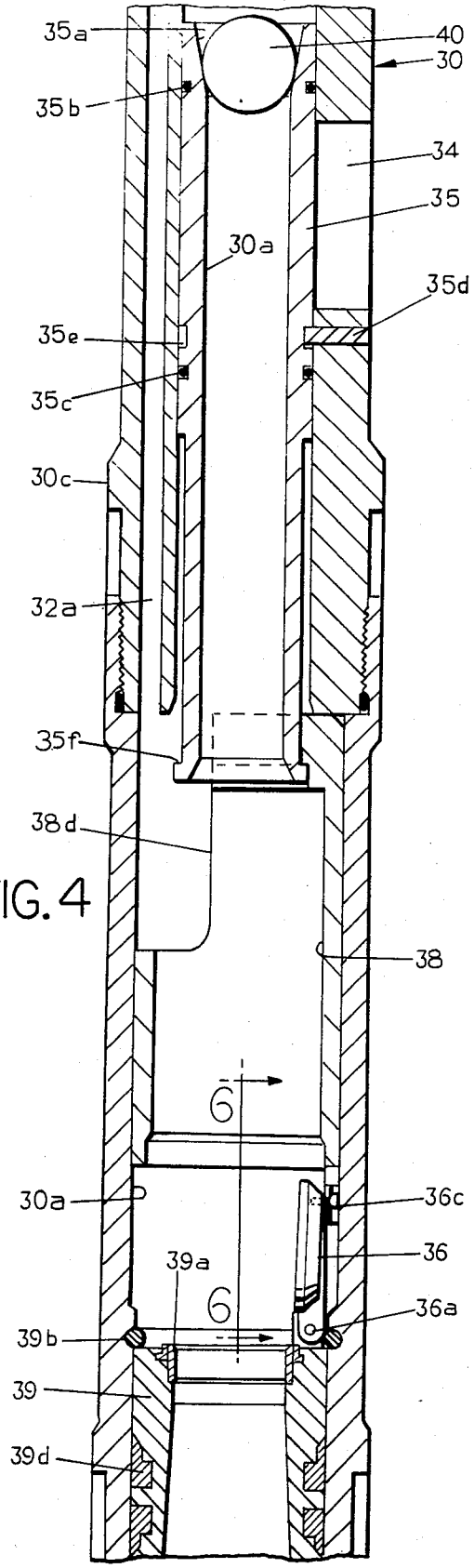
FIG. 4 is an enlarged scale vertical sectional view of a portion of the apparatus of FIG. 1*a*, illustrating in particular, the mounting of the flapper valve, with the valve shown in its open position.

In the run-in position of the hollow crossover mandrel, the crossover port 34 is closed by a sleeve 35 which defines at its upper end, a conical ball valve seat 35*a* (FIG. 4). Seals 35*b* and 35*c* respectively located above and below the crossover port 34 assure that such port will be sealed by sleeve 35 against any fluid flow from the bore 30*a* of the hollow crossover mandrel 30. The ball valve seat sleeve 35 is retained in the aforedescribed position with respect to the crossover port 34 by a shear pin 35*d* in the mandrel wall which engages a suitable annular groove 35*e* in the outer periphery of the sleeve 35.

Below the position of the ball valve seat sleeve 35, a flapper valve 36 is mounted for movement about a horizontal pin 36*a* from a vertical position, in which it does not significantly obstruct the bore 30*a* of the hollow crossover mandrel, to a horizontal position, shown in FIG. 5, wherein it cooperates with an upwardly facing, annular sealing surface 39*a* (FIG. 4) surrounding bore 30*a*. The flapper valve seat 39*a* is defined on the top portion of a second valve sealing sleeve 39 which is secured in a fixed position in the axial bore 30*a* of the hollow crossover mandrel 30 by a pair of C-rings 39*b* and 39*c* respectively engaging the top and bottom surfaces of the sleeve 39 and appropriate grooves formed in the bore 30*a*. Conventional sealing elements 39*d* are provided between the external surface of the sleeve 39 and bore 30*a* to prevent fluid leakage between the external surface of the valve seat 39 and the bore surface 30*a* of the hollow crossover mandrel 30. A torsion spring (not shown) is provided for flapper valve 36 to urge it towards its horizontal or closed position.

Figure 6:
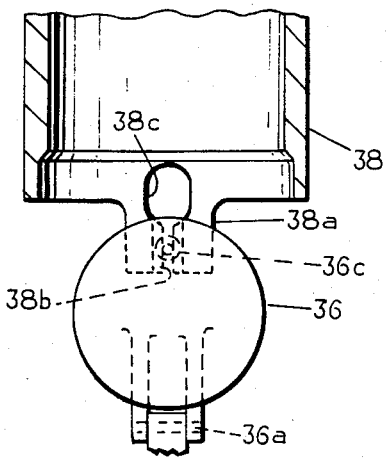
FIG. 6 is a sectional view taken on the plane 6—6 of FIG. 4.
Figure 5:
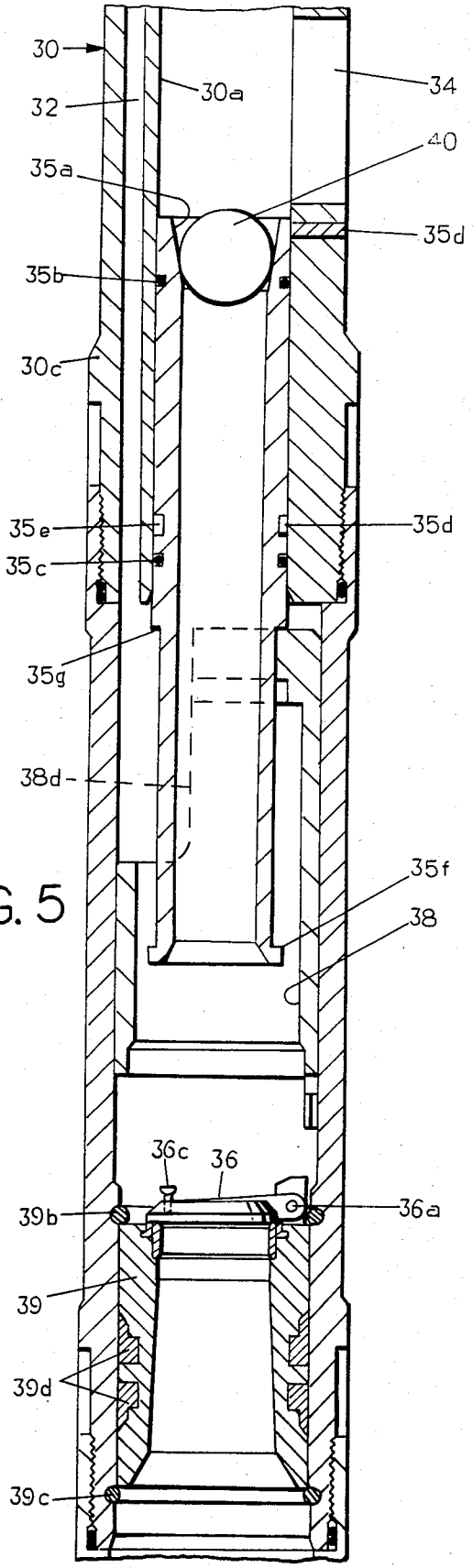
FIG. 5 is a view similar to FIG. 4 but showing the flapper valve in its closed position.

As it is best shown in the enlarged FIGS. 4–6, the flapper valve 36 includes a radially disposed, enlarged head, locking pin 36*c*. In the run-in position of the crossover mandrel 30, the shank portion of the enlarged head locking pin 36*c* is disposed within a narrow slot 38*b* defined by an axial projection 38*a* formed on the bottom end of a sleeve 38 which in turn is hung onto a radial flange 35*f* on the bottom end of the valve sleeve 35. The retaining slot 38*b* provided in the axial projection 38*a* of connecting sleeve 38 is enlarged at its upper end as shown at 38*c* so as to permit the headed locking pin 36*c* of flapper valve 36 to freely pass therethrough and permit the valve to assume its horizontal closed position in engagement with the valve seat 39*a* whenever the connecting sleeve 38 is moved axially downwardly by displacement of the valve seat sleeve 35 in a manner to be hereinafter described.

The connecting sleeve 38 is provided with a cutout portion 38*d* extending approximately half way around the upper portion of the sleeve to provide unimpeded communication between mandrel bore 30*a* and semi-annular passage 32*a*.

OPERATION

As previously mentioned, the entire apparatus which has heretofore been described, is run into the well casing 1 on the end of the tubular work string 2 and the perforating gun 5 is positioned opposite a region in the well casing where a production formation exists. With the perforating gun so located, the lower packer 6 is then set by manipulation of the tubular work string 2 (FIG. 2).

A detonating weight or bar 5*a* is then dropped through the tubular work string 2 and passes through the unimpeded axial bore 30*a* of the hollow crossover mandrel, bore 6*c* of lower packer 6, and nipple 9 and impacts on the top of the perforating gun 5, discharging the explosive charges contained therein and driving the charges carried by the gun outwardly to perforate the casing 1 and produce the perforations 1*b* as illustrated in FIG. 2.

Preferably prior to the firing of the perforating gun 5, the bore of the tubular work string 2 is filled with a light density fluid so that when the gun is fired, the work string will be in an "under balanced" condition, i.e., hydraulic fluid pressure at the face of the formation when the gun is fired will be less than the formation pressure, which insures that the formation pressure will force fluid into the well bore and upwardly to the surface. Such light fluid is introduced prior to the setting of the lower packer 6 and is pumped down through the tubular work string 2 displacing any heavier fluid existing in the work string, such as drilling mud, out of the bottom of the inserted apparatus through the perforated nipple 9 below the lower packer and returning to the surface around the outside of the lower packer 6, since it is not yet set.

In most cases, it is desirable to permit oils or other fluid contained in the production formation to freely flow through the perforations 1*b* to effect a flushing of such perforations and the fissures in the formation. Such fluid flow enters the axial bore 30*a* of the hollow crossover mandrel assembly 30 through the perforations 9*a* provided in the connecting nipple 9 and flows freely up to the work string 2 and then to the top of the well.

After a sufficient flow period to insure the adequate flushing of the perforations, the well flow is closed in conventional fashion by the introduction of a heavy kill fluid downwardly through the tubular work string 2.

Figure 3A:
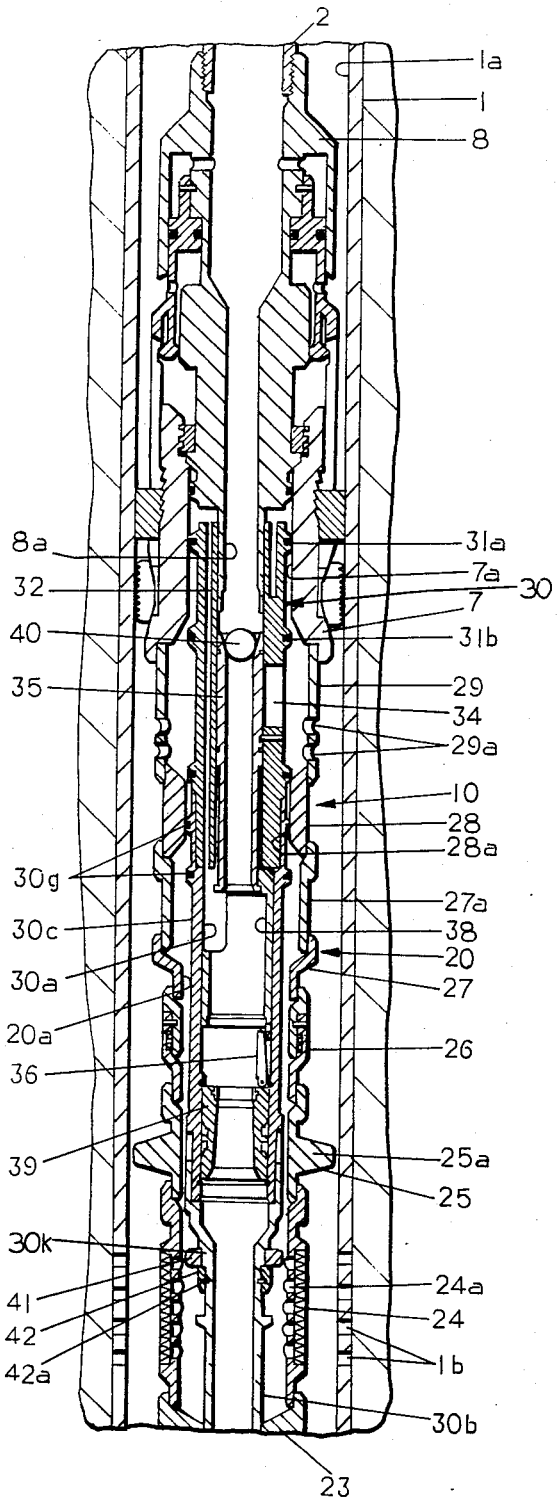
FIGS. 3*a* and 3*b* are views similar to FIGS. 1*a* and 1*b* but showing the position of the elements of the apparatus after the perforating operation and at the beginning of the gravel packing operation, FIG. 3*b* being a vertical continuation of FIG. 3*a*.
Figure 3B:
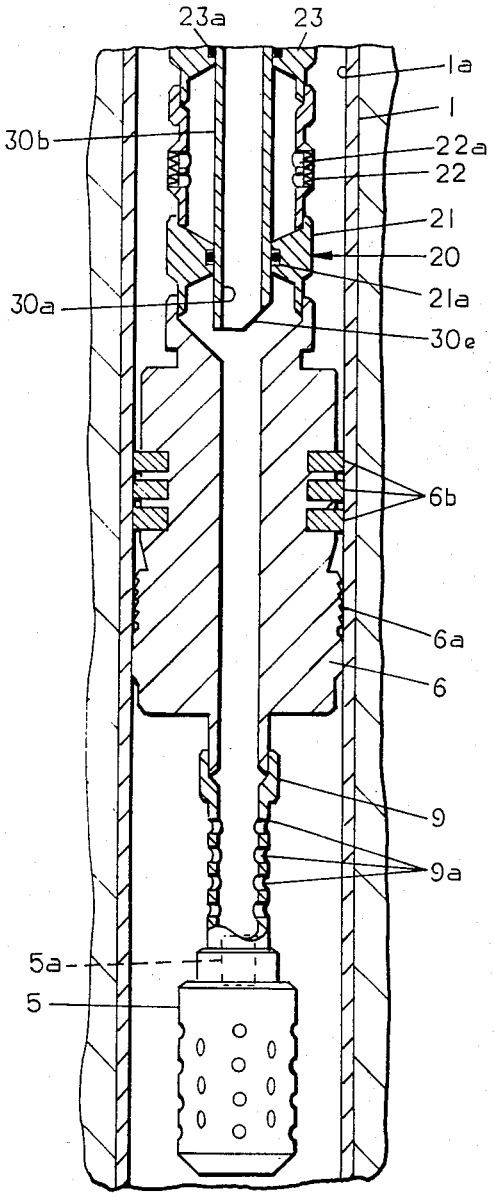

As soon as the well is under control by the kill fluid, the lower packer 6 is released by manipulation of the work string 2. The entire assembly is lowered down the well bore so that the main screen 24 is positioned opposite the newly produced perforations 1*b* (FIG. 3*a*). At this position, the lower packer 6 is then reset by manipulation of the tubular work string 2 (FIG. 3*b*). The lower packer now in essence becomes a sump packer and is generally permitted to remain in that position (FIG. 3*b*).

To initiate the gravel packing operations, the upper packer 7 is set through the application of fluid pressure through the tubular work string 2. To apply such fluid pressure, a ball 40 is dropped through the tubular work string and seats on the ball valve seating surface 35*a* defined by the valve seat sleeve 35. The fluid pressure within the work string and the upper portion of the hollow tubular mandrel assembly 30 may now be increased to a level which will effect the hydraulic operation of the actuator 8 which effects the setting of the upper packer 7 in conventional manner (FIG. 3*a*). After setting of the upper packer 7, the fluid pressure within the tubular work string 2 is then increased to an extent that a shearing of the shear pin 35*d* is accomplished and the ball valve seat sleeve 35 moves downwardly, thus uncovering the crossover port 34 in the crossover mandrel 30 (FIG. 5.). Alternatively, the valve seat sleeve 35 may be shifted downwardly mechanically by a wireline applied force. Such downward movement is, of course, transmitted directly to the connecting sleeve 38 by a downwardly facing shoulder 35*g* which moves the enlarged portion 38*c* of the locking slot 38*b* into alignment with the locking pin 36*c* of the flapper valve 36 and permits the flapper valve 36 to shift to its horizontal, closed position as shown in FIG. 5, under the bias of the torsion spring. The actuator 8 is released therefrom and moved upwardly by work string 2 until an indicator ring 41 on the crossover mandrel 30 contacts the bottom of seal bore 28. The hollow mandrel assembly 30 is thus elevated to position its open bottom end 30*e* at a point above the lowermost O-ring seal sub 21 provided on the lower portion of the liner assembly 20.

As mentioned, the initial raised position of the hollow mandrel assembly 30 is determined by the engagement of the locating ring 41 which surrounds the lower, reduced diameter portion 30*k* of the enlarged upper portion 30*c* of the hollow mandrel assembly 30. Ring 41 is of C-shaped configuration and expanded to engage the bottom end of the seal bore 28. The ring 41 is releasably retained in its expanded position on the crossover mandrel 30 by a sleeve 42 which is slidable upon the lower cylindrical mandrel portion 30*b* and retained in its uppermost position by one or more shear pins 42*a*. Thus, when it is desired to raise the crossover mandrel 30 further by raising the work string 2, sufficient upward force is applied to the tubular work string 2 to effect the shearing of the shear pins 42*a* and this permits the positioning C-ring 41 to move downwardly over the smaller diameter mandrel portion 30*b* where it will contract so as to freely pass through the bore defined by the seal bore 28. The plurality of axially spaced seals 30*g* provided on the periphery of the upper enlarged mandrel portion 30*c* insures that at all times, one or the other of such seals is engaged with seal bore 28 as the vertical position of the hollow mandrel assembly 30 is shifted during the operation of the device for gravel packing.

The fluid pressure within the tubular work string may then be reduced and a gravel carrying fluid introduced into the gravel packing apparatus through the tubular work string 2. The flow path of such gravel carrying fluid through the gravel packing portion of the apparatus 10 is conventional, passing first into the axial bore 30*a* of the hollow mandrel assemblage and then radially outwardly through the crossover port 34 into the annulus between the crossover mandrel 30 and the surrounding liner assembly 20. The fluid then flows through the ports 29*a* provided in the tubular element 29 into the annulus defined between the casing 1 and the outer periphery of the liner assembly 20. The gravel carrying fluid thus flows downwardly through the casing annulus to a position opposite the telltale screen 22. The gravel portion of the fluid will not pass the screen apertures 22*a* while the fluid passes inwardly to the internal bore 20*a* of the liner assembly.

The fluid then enters the bottom semi-annular portion 32*a* of the annular fluid passage 32 provided in the hollow crossover mandrel 30. It cannot flow directly upwardly through the axial bore 30*a* because such bore is blocked by the ball valve 40 which is subjected to the full downward pressure of the gravel carrying fluid to maintain a sealing engagement with the valve seat 35*a* provided on the valve seat sleeve 35. The fluid then flows through the top open end of the annular passage 32 and into the casing annulus at a point above the sealing surface 7*a* of the upper packer 7, because the actuator 8 has been shifted upwardly to position the top open end of annular passage 32 above the packer 7.

When the telltale screen 22 is fully covered with gravel, indicating that the gravel has reached the lowermost extremity of the region to be packed, the operator will detect a pressure increase.

Once the operator receives the pressure indication that the telltale screen 22 has been fully packed with gravel, the work string 2 may then be raised upwardly an additional distance, carrying the hollow crossover mandrel 30 with it, to, for example, position the open bottom end 30*e* of the hollow crossover mandrel assemblage at a position above the seal sub 23 in the liner 20. This then permits the gravel packing operation to continue, with the fluid flow being through the main screen 24, then upwardly through the annular passage 32, and then outwardly into the casing annulus at a point above the upper packer 7.

The packing operation is continued until the pressure build up indicates to the operator that the entire main screen 24 and the adjacent perforated area of the formation have been filled with gravel. At this point, there is generally excess gravel in the tubular work string 2 and after shearing the screws 42*a* by packing up on the work string 2, a reverse fluid flow is applied to the work string 2 to remove the excess gravel. Such reverse flow is, of course, accomplished in conventional fashion by pressurizing the casing annulus and flowing the fluid through the crossover port 34 into the bore 30*a* of the hollow crossover mandrel 30 and then upwardly through the tubular work string 2. It is during this operation that the flapper valve 36 performs its primary function in that it prevents the reversing fluid from entering the fluid bypass system that goes around the crossover port 34, and going down through the bore 30*a* of the crossover mandrel 30 to the formation.

Following completion of the removal of the excess gravel, the setting tool or actuator 8, with the hollow crossover mandrel 30 connected thereto, is removed from the well and the well is ready for subsequent testing or production operations.

While the invention has been described in terms of a specific application of the unique crossover mandrel construction to accomplishing the perforating of a well and gravel packing the perforated area in a single trip of the apparatus into the well, those skilled in the art will recognize that any operation below the gravel packing area requiring the axial passage of a tool or instrument through the unrestricted axial bore of the hollow crossover mandrel assembly embodying this invention, could also be accomplished. Thus, testing operations in a perforated well could be accomplished below the gravel packing apparatus with a single trip of the entire apparatus into the well.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. The method of perforating and gravel packing the production zone of a subterranean well with one trip of a work string comprising the steps of:

(1) assembling at the surface for attachment to the end of a tubular work string a hollow liner assembly including a production screen, a first settable and releasable packer secured to the lower end of the hollow liner assembly, a hydraulically settable packer secured to the upper end of the hollow liner assembly, a perforating mechanism supported below the lower packer by a length of tubing, a pressure operated actuator releasably connected to the first packer, and a hollow crossover mandrel assembly connected to the actuator and insertable within the liner assembly and defining a horizontal annular ball seat intermediate said first and second packers;

(2) lowering the work string with the above listed assemblies thereon into the well until the perforating mechanism is positioned adjacent to the desired production zone;

(3) setting the first packer in a position immediately above the desired production formation with said perforating mechanism adjacent the desired production zone;

(4) inserting a perforation activating element through the hollow work string and the bore of the hollow mandrel assembly, the second packer, and the tubing supporting the perforating mechanism to discharge the perforating mechanism and perforate the casing;

(5) releasing said first packer and lowering the work string to position said first packer below the perforated production zone, and then resetting said first packer;

(6) dropping a ball through the work string to seat on said annular ball valve seat in the hollow crossover mandrel assembly thereby permitting fluid pressure to be built up within the work string;

(7) increasing the fluid pressure in the work string to a level sufficient to cause the actuator to set said second packer;

(8) increasing the fluid pressure in the work string to a level sufficient to cause the downward displacement of the valve seat element of said hollow crossover mandrel assembly and open a radial fluid passage from the bore of said hollow crossover mandrel to the bore of said liner assembly;

(9) releasing a flapper valve to close the bore of the hollow crossover mandrel assembly by the downward movement of the ball seat sleeve; and

(10) introducing gravel carrying fluid through the work string to flow through said radial passage and passages defined by the hollow crossover mandrel and the hollow liner assembly downwardly along the casing annulus between said first and second packers, through the production screen, and upwardly through the crossover assemblage to the casing annulus at a point above said second packer.

2. A gravel packing apparatus for use in a well bore and adapted to be run into the well casing on a tubular work string, comprising, in combination: an axially elongated tubular liner assembly including a hollow screen element; a packer secured to the upper end of said tubular liner assembly; a work string supported setting tool releasably connected to said packer, said setting tool having pressure responsive means for expanding said packing into sealing engagement with the well casing at a position wherein said hollow screen element is disposed adjacent the perforated production zone of the well casing; a hollow crossover mandrel assembly depending from said setting tool, said hollow crossover mandrel assembly being insertable in said liner; all of the aforementioned apparatus defining, in the run-in position, a continuous axial passage to permit dropping therethrough a tool element; a valve seat sleeve mounted in the bore of said hollow mandrel assembly; means for retaining said sleeve in an initial run-in position, said sleeve adapted to receive a seal to permit build up of fluid pressure in the work string to expand said packer into sealing engagement with said casing above said production zone; said liner and said hollow crossover mandrel assembly having flow passages and spaced sealing means selectively positionable upon movement of said seat sleeve downwardly relative to said packer from said initial run-in position to a second position for directing gravel carrying fluid flowing downwardly through the work string into the casing annulus above said screen, then through said screen into the bottom of said hollow crossover mandrel assembly and then outwardly into the well casing annulus at a point above said packer, thereby permitting the packing of gravel around said hollow screen, said valve seat sleeve being shiftable to said second position upon one of: (1) a further increase in fluid pressure in said work string over that required to set said packer; and (2) application of machanical force; and a flapper valve pivotally mounted in the crossover mandrel assembly at a position below said initial position of said valve seat sleeve, an annular horizontal seat around the bore of said crossover mandrel assembly cooperable with said flapper valve to close said bore to downward fluid flow, resilient means urging said flapper valve to its said sealing position, latching means for holding said flapper valve in a vertical open run-in position, and means responsive to the downward displacement of said valve seat sleeve from its run-in position for releasing said latching means to permit said flapper valve to close.

3. A gravel packing apparatus for use in a well bore and adapted to be run into the well casing on a tubular work string, comprising, in combination: an axially elongated tubular liner assembly including a hollow screen element; a packer secured to the upper end of said tubular liner assembly; a work string supported setting tool releasably connected to said packer, said setting tool including means for expanding said packer into sealing engagement with the well casing at a position wherein said hollow screen element is disposed adjacent a production zone of the well casing; a hollow crossover mandrel assembly depending from said setting tool, said hollow crossover mandrel assembly being insertable in said liner, all of the aforementioned apparatus defining, in the run-in position, a continuous axial passage to permit dropping a tool element therethrough; a valve seat sleeve mounted in the bore of said hollow mandrel assembly; means for retaining said sleeve in an initial run-in position; said sleeve being adapted to receive a sealing element on its upper end surface to permit build up of fluid pressure in the work string to move said sleeve downwardly from its run-in position, thereby shearing said shearable means; said liner and said hollow crossover mandrel assembly having flow passages and spaced sealing means selectively positionable upon said movement of said valve seat sleeve downwardly to a second position for directing gravel carrying fluid flowing downwardly through the work string into the casing annulus above said screen, then through said screen into the bottom of said hollow crossover mandrel assembly and then outwardly into the well casing annulus at a point above said packer, thereby permitting the packing of gravel around said hollow screen; an annular horizontal valve seat around the bore of said hollow crossover mandrel assembly at a point below said second position of said valve seat sleeve; a valve head shiftably mounted in the crossover mandrel assembly and cooperable with said annular horizontal seat to close the bore of the hollow crossover mandrel assembly to downward fluid flow, latching means for holding said valve head in an open position relative to said annular horizontal seat and with said valve head disposed outwardly of said continuous axial passage; and means responsive to the downward displacement of said valve seat sleeve to said second position for releasing said latching means to permit said valve head to shift into engagement with said annular horizontal seat.

* * * * *